United States Patent [19]

Aberg

[11] 4,449,388

[45] May 22, 1984

[54] METHOD OF BENDING SHAPED METAL SHEET AND APPARATUS FOR CARRYING OUT THE METHOD

[75] Inventor: Seard Åberg, Gammelstad, Sweden

[73] Assignee: Groko Maskin AB, Stockholm, Sweden

[21] Appl. No.: 315,609

[22] PCT Filed: Mar. 2, 1981

[86] PCT No.: PCT/SE81/00054

§ 371 Date: Oct. 27, 1981

§ 102(e) Date: Oct. 27, 1981

[87] PCT Pub. No.: WO81/02535

PCT Pub. Date: Sep. 17, 1981

[30] Foreign Application Priority Data

Mar. 4, 1980 [SE] Sweden ..... 8001670-2

[51] Int. Cl.[3] ..... B21D 7/06

[52] U.S. Cl. ..... 72/381; 72/385

[58] Field of Search ..... 72/379, 380, 381, 383, 72/384, 385, 386, 168, 306, 307

[56] References Cited

U.S. PATENT DOCUMENTS

| | | | |
|---|---|---|---|
| 3,664,170 | 5/1972 | Davis | 72/307 |
| 3,838,590 | 10/1974 | Van Dijk | 72/379 |
| 4,220,031 | 9/1980 | Naslund | 72/379 |

FOREIGN PATENT DOCUMENTS

| | | | |
|---|---|---|---|
| 24147 | of 1908 | United Kingdom | 72/386 |

*Primary Examiner*—Lowell A. Larson

*Attorney, Agent, or Firm*—Kenyon & Kenyon

[57] ABSTRACT

This invention relates to the bending of shaped sheet metal, which shows alternatingly occurring longitudinal ridges and valleys, the lateral portions of which constitute lateral portions of the ridges, about an axis, which extends perpendicularly to the longitudinal direction of the ridges and valleys and is in parallel with the plane of the sheet. Known methods of bending such shaped sheet metal have proved to have certain limitations with respect to applicability and smallest bending radius to be obtained in one or more coherent bending moments or steps. For eliminating these shortcomings a method of bending shaped sheet metal is proposed, at which the bending takes place in at least two subsequent moments or steps. At the first bending moment transverse ridges are formed from below along at least one line in parallel with said axis in the valleys for partially bending the sheet (A), and at the second bending moment transverse ridges are formed from below on both sides of the transverse ridges formed at the first bending moment, for finally bending the sheet (A) to the desired bending angle.

2 Claims, 24 Drawing Figures

METHOD OF BENDING SHAPED METAL SHEET AND APPARATUS FOR CARRYING OUT THE METHOD

Figure 1:
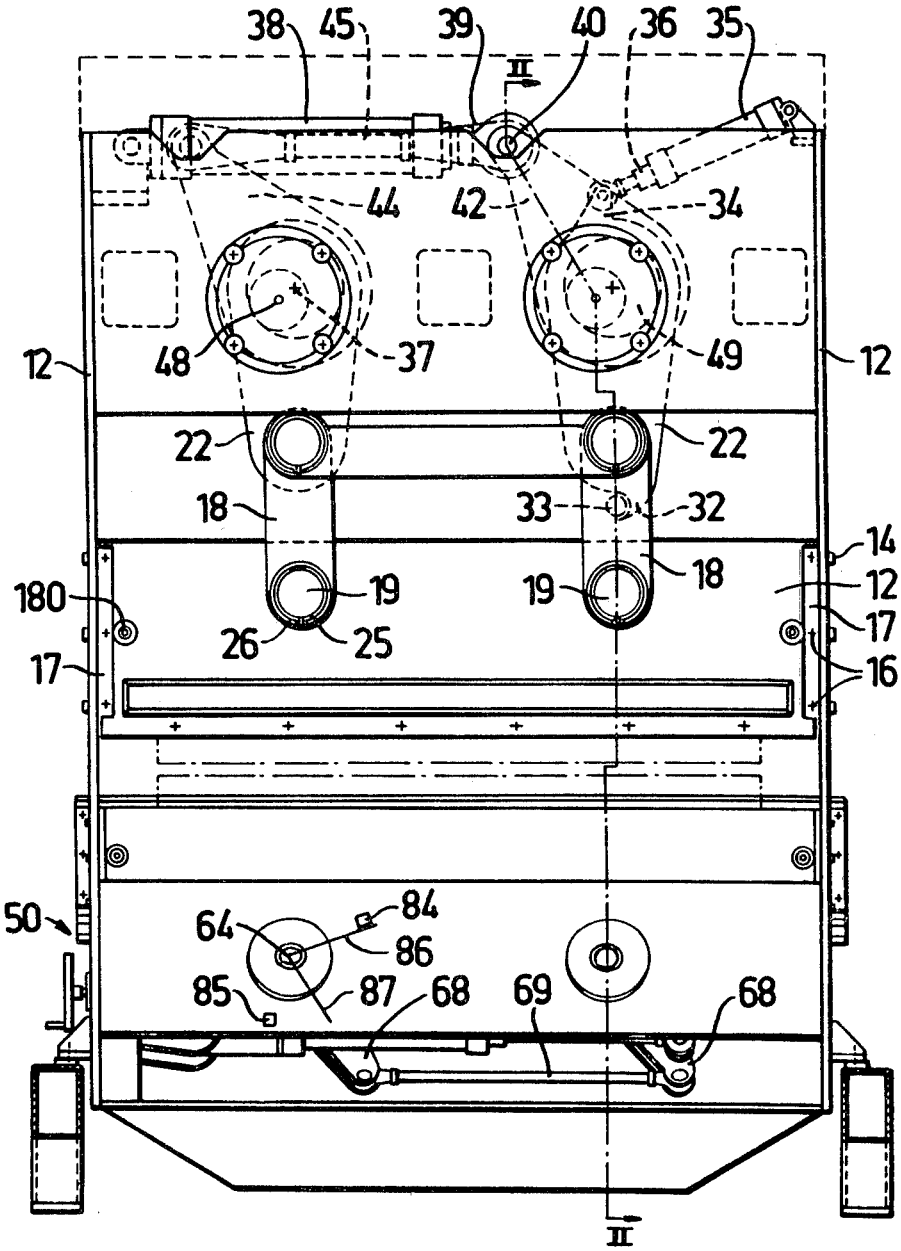

This invention relates to a method of bending shaped or corrugated metal sheet, which has alternatingly occurring longitudinal ridges and valleys, the side portions of which also constitute the side portions of the ridges, about an axis, which extends perpendicularly to the longitudinal direction of the ridges and valleys and is in parallel with the plane of the metal sheet. The invention further relates to an apparatus for carrying out the method.

For bending such shaped or corrugated metal sheets, plates, strips and the like of metal about an axis, which extends perpendicularly in relation to the longitudinal direction of the shaping and is in parallel with the plane of the sheet, it is previously known from U.S. Pat. Nos. 4,195,511 and 4,220,031, to form in the corrugations, the tops of which are located closest to said axis, strip-shaped projections in the direction of the axis which project from one and the same side of the sheet. Each such projection extends continuously over at least a portion of the lateral portion and intermediate portion of the respective corrugation, and the projections are given such shape that the sheet is shrunk more closest to the axis than farthest away from it. By this method of bending shaped metal sheet, in the zone of transition between the lateral portions of the corrugation and the intermediate portion an accumulation of material is obtained which renders it impossible to bend shaped metal sheets provided with a surrace-covering coat, without damaging the coat on one side or the other, which can give rise to weakenings in the material at the bending place. It is not possible either, with this known method to bend a shaped sheet to a radius smaller than about 750 mm, which is a substantial limitation of the applicability of the bending method. It further is known to bend shaped metal sheet about an axis, which extends perpendicularly to the longitudinal direction of the shaping and in parallel with the plane of the sheet, according to which method impressions are effected from below in those portions of the corrugations of the sheet which are facing toward said axis. Said impressions are made in subsequent steps until the desired bending angle is achieved. As by this known method a relatively small bending angle, for example 15°, is obtained for each bending operation, i.e. for each impression, consequently six subsequent bending operations are required for obtaining a total bending angle of 90°.

The present invention, therefore, has the object a.o. to provide a bending method, which can be applied to substantially all existing types of shaped or corrugated metal sheet, and which renders possible the bending of such shaped sheet up to at least 90° in one step or bending moment, and which, besides, shall be careful to the sheet and not weaken it to an appreciable degree at and about the place of bending.

In order to achieve this object, according to the present invention a bending method and an apparatus are proposed, which have been given the characterizing features defined in the attached claims.

Figure 2:
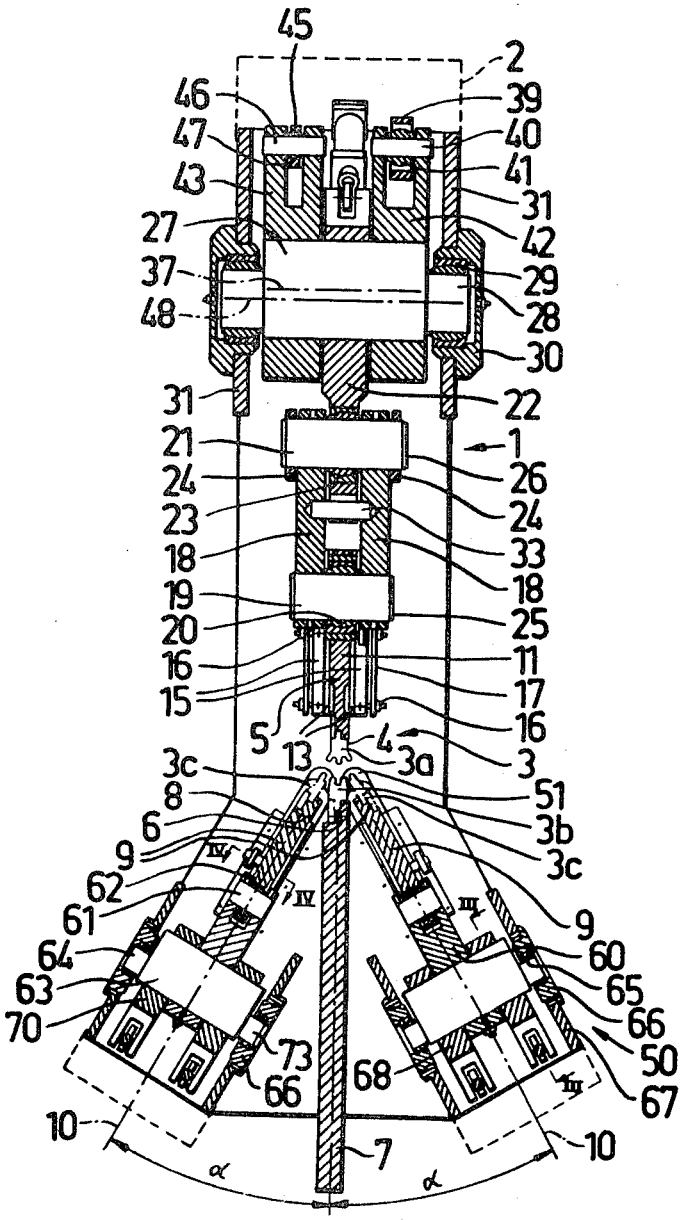
Figure 3:
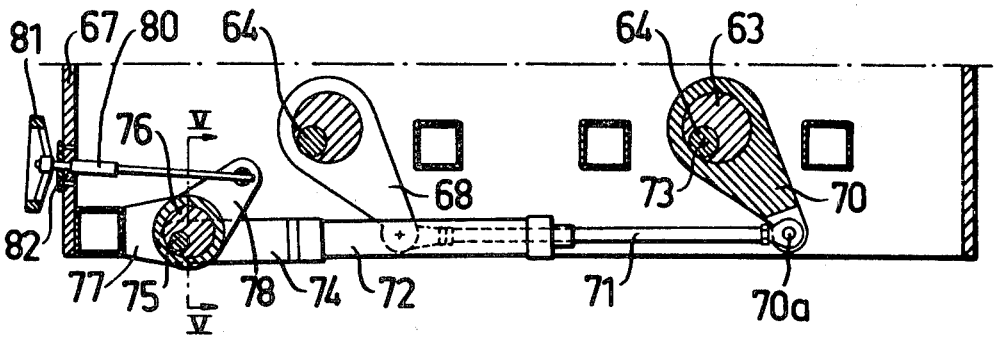
Figure 4:
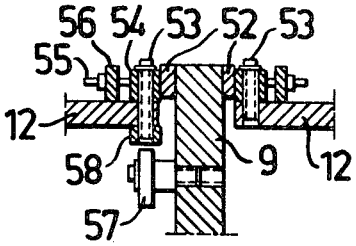
Figure 5:
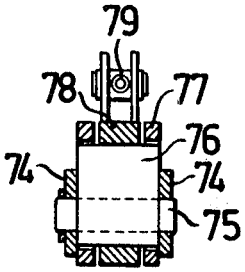
Figure 6A:
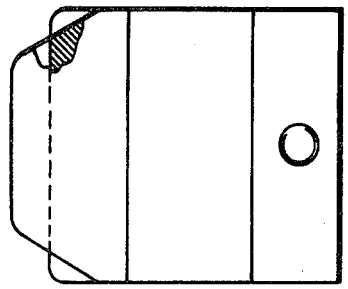
Figure 6:
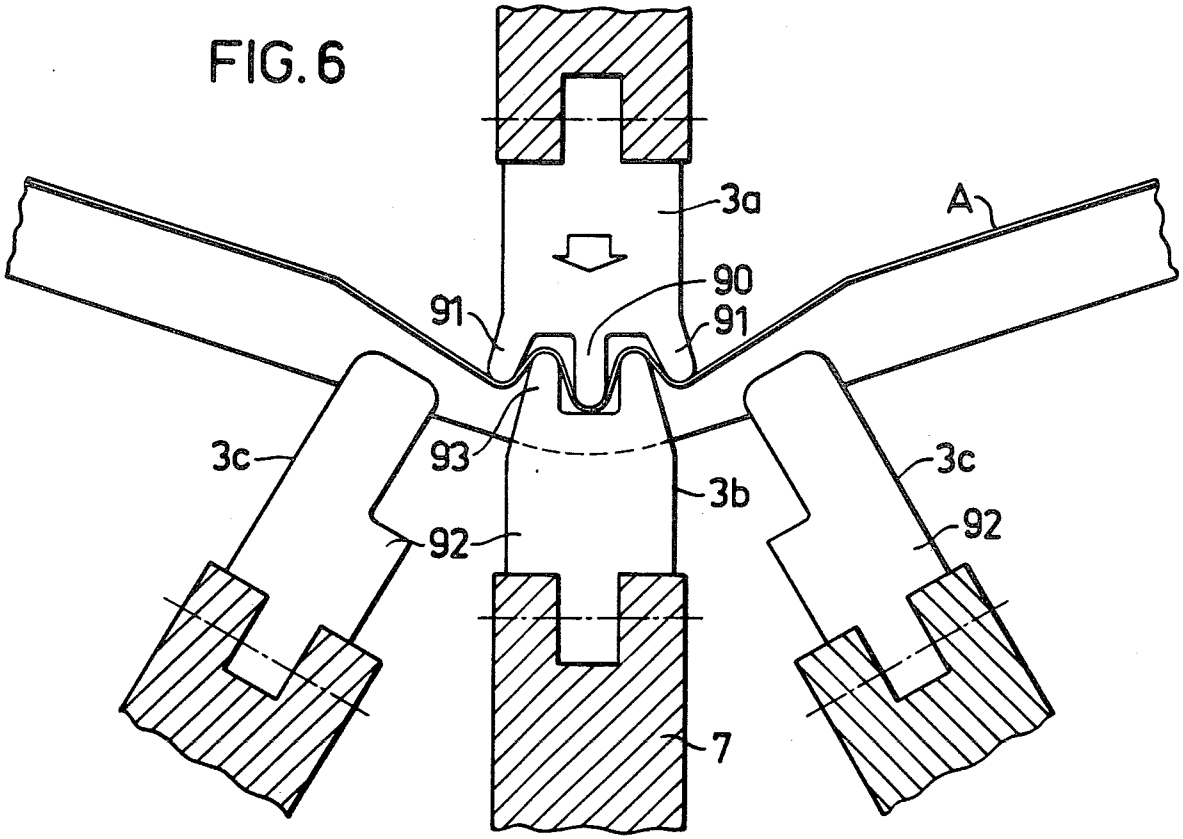
Figure 7:
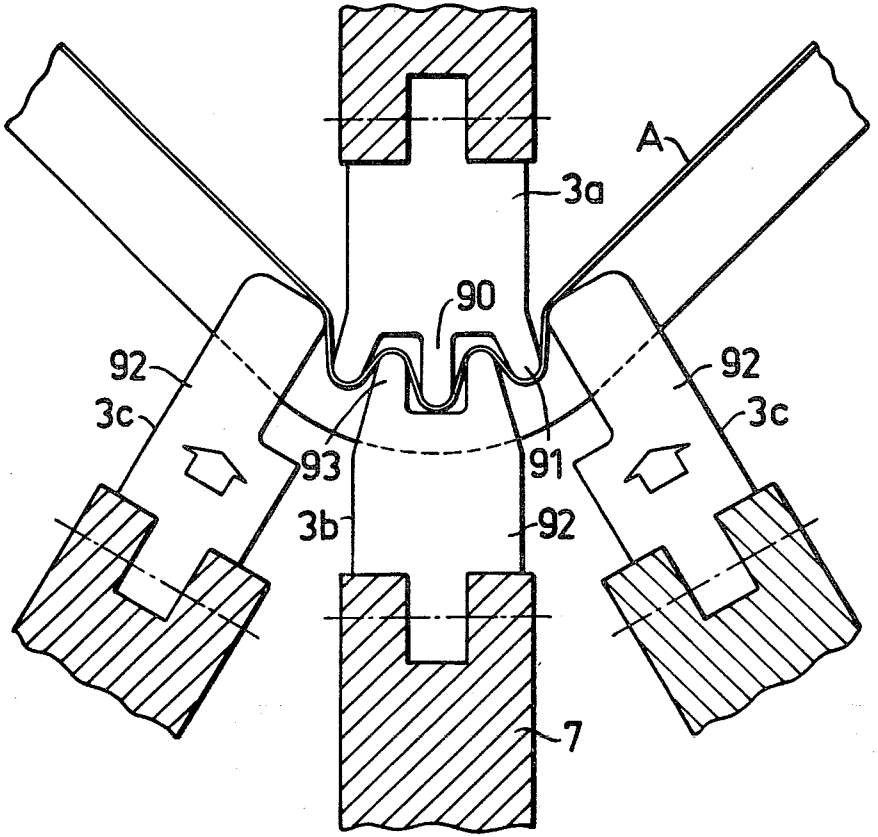
Figure 8:
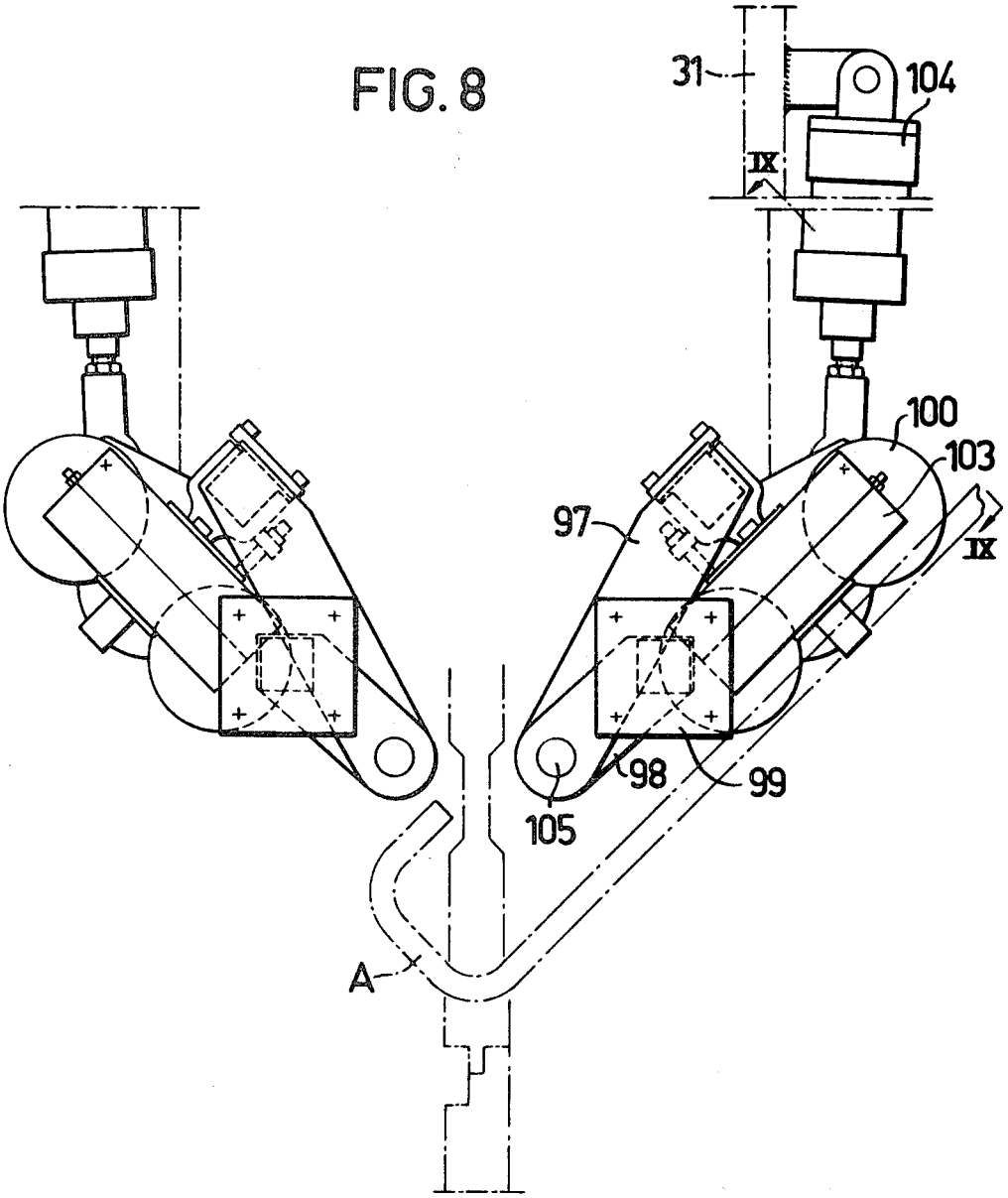
Figure 9:
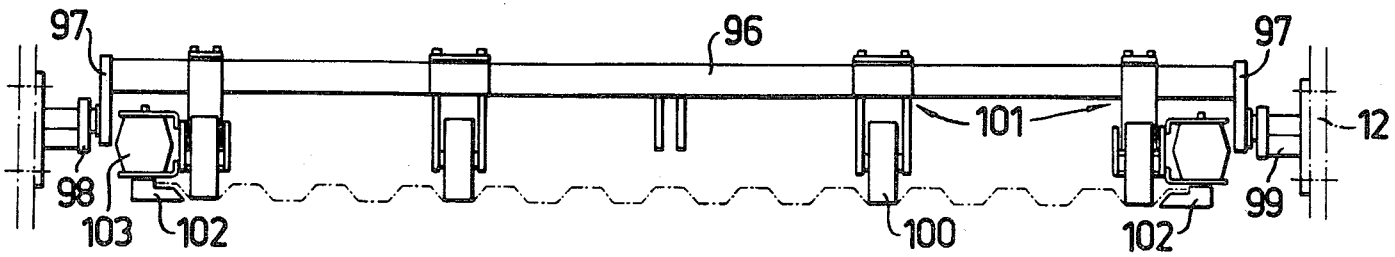
Figure 10:
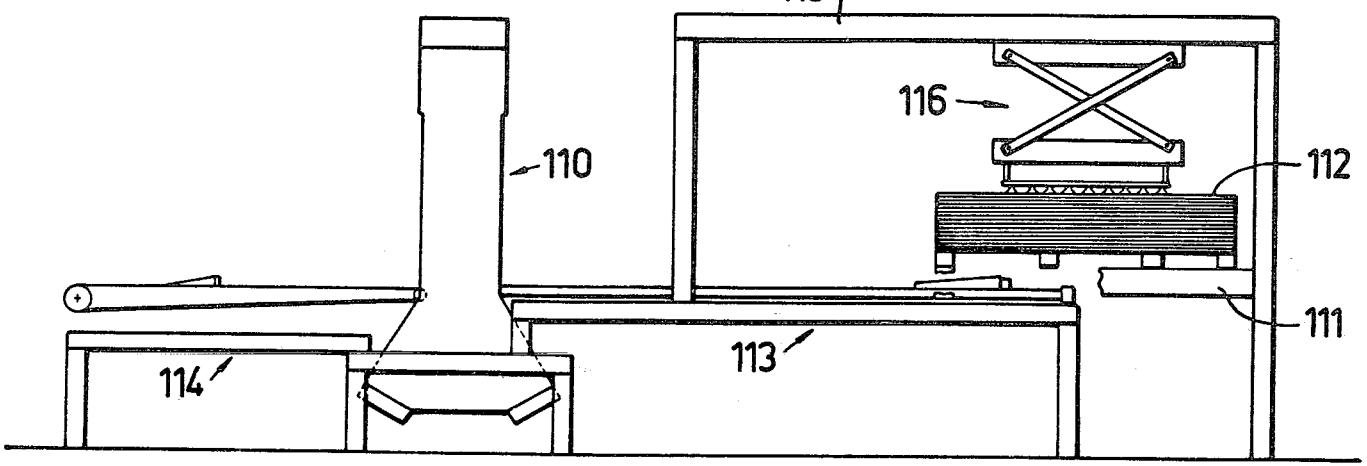
Figure 12:
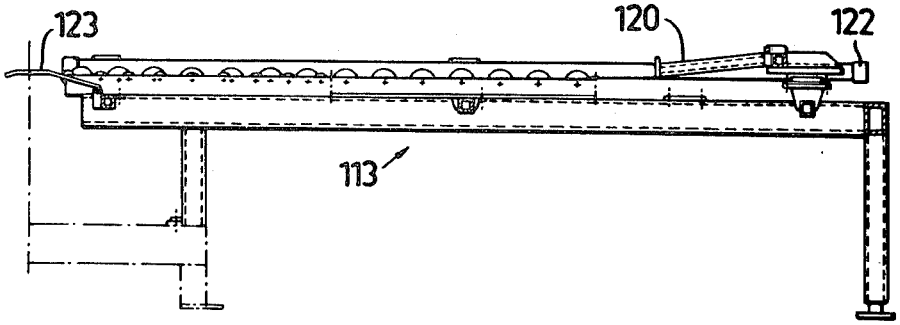
Figure 11:
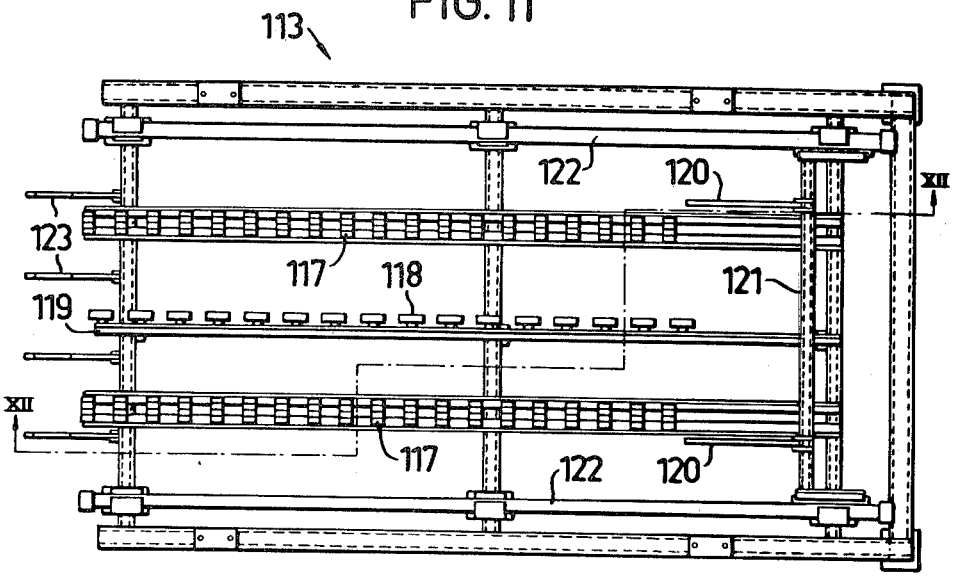
Figure 14:
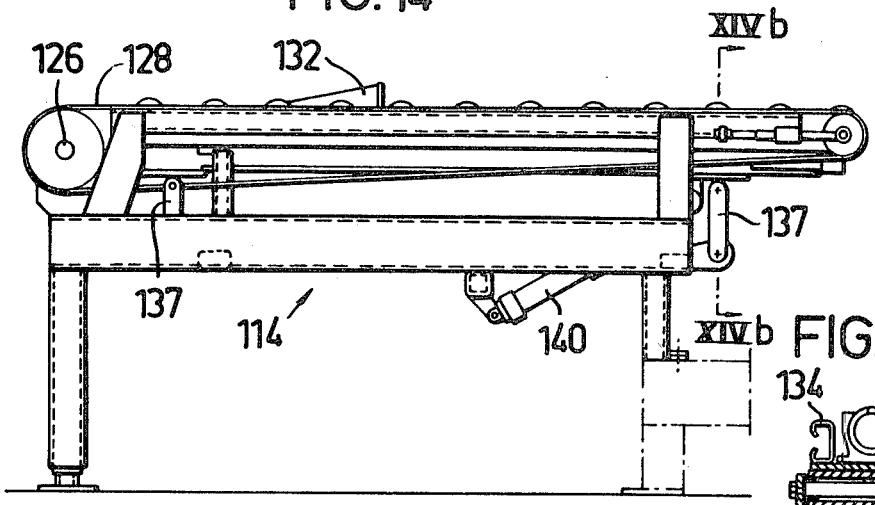
Figure 14B:
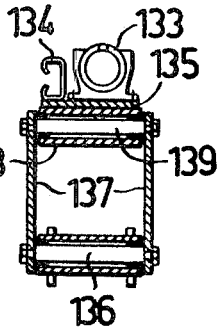
Figure 13:
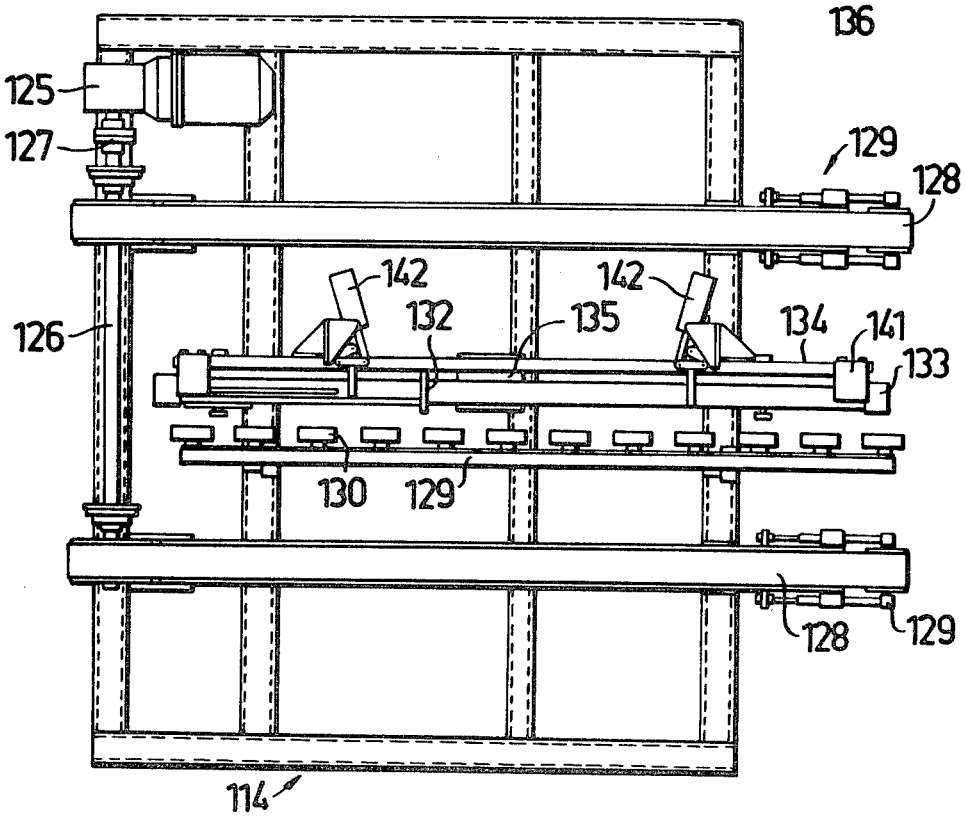
Figure 15A:
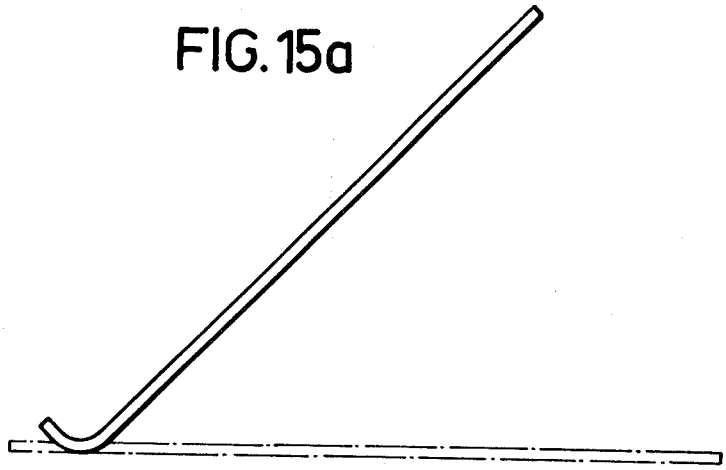
Figure 15B:
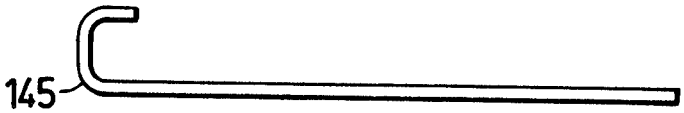
Figure 15C:
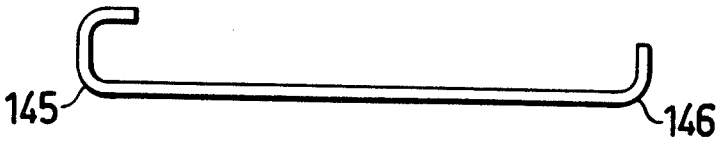
Figure 15D:
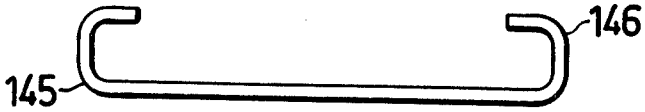

The invention is described in the following in greater detail, with reference to the accompanying drawings, in which FIG. 1 is a lateral view of a bending and pressing frame according to the invention, FIG. 2 is a section along the line II—II in FIG. 1, FIG. 3 is a section along the line III—III in FIG. 2 on an enlarged scale, FIG. 4 is a section along the line IV—IV in FIG. 2 on an enlarged scale, FIG. 5 is a section along the line V—V in FIG. 3 on an enlarged scale, FIGS. 6, 6*a* and 7 show in a schematical way the bending tool according to the invention and together illustrate the principle, on which the method according to the invention is based, FIG. 8 is an end view of strippers arranged on each side of the pressing frame, FIG. 9 is a view along the line IX—IX in FIG. 8, FIG. 10 is a schematic lateral view of a plant provided with the bending frame according to the invention and capable to bend corrugated sheets for pallets, FIG. 11 is a horizontal view of the infeed table in the plant shown in FIG. 10, FIG. 12 is a section along the line XII—XII in FIG. 11, FIGS. 13 and 14 are a horizontal view and, respectively, a lateral view of the discharge or receiving table of said plant, FIGS. 15*a–d* illustrate the bending sequence for the bending of a corrugated sheet to a first type of a pallet, FIGS. 16*a–e* illustrate the bending sequence for the bending of a corrugated sheet to a second type of pallet.

The apparatus according to the present invention for bending corrugated metal sheet comprises a bending or pressing frame 1, which consists of a stand 2 and is provided with a bending tool generally designated by 3. This tool is assembled of several parts, viz. a punch 3*a*, which by screw or bolt joint 4 is detachably, and thus exchangeably, secured on an upper vertically movable tool holder 5, and three dies 3*b*, 3*c*, of which the one designated by 3*b* by a screw or bolt joint 6 is detachably connected to a plate 7, which as an anvil or dolly is rigidly secured in the stand 2, while the two remaining dies 3*c* by screw or bolt joints 8 are connected each to a lower tool holder 9, which are provided on each side of the anvil plate 7 and each are movable in a plane 10 forming an angle $\alpha$ with the anvil plate 7. This angle $\alpha$ can be between 10° and 50° and should preferably be about 30°, as shown at the embodiment illustrated in the drawings.

The upper tool holder 5 is a plate 11, to the lower edge of which the punch 3*a* is detachably attached, and which extends between end walls 12 of the stand. At these end walls the plate 11, by means of slide strips 13 attached to its ends, is movably guided between parallel guide strips 15, which by means of screws 14 are connected to the end walls 12 and are adjustable by means of set screws 16 provided in bars 17 attached to the end walls 12. In order to prevent the plate 11 from moving in its longitudinal direction between the end walls 12, the plate is provided at each end with guide rollers 180 co-operating with the guide strips 15.

The tool holder plate 11 is suspended on two spaced links 18, each of which consists of two parallel parts, which are connected to the plate 11 each by its axle 19. Each axle 19 is rotatably mounted in the plate 11 by means of bearings 20 located between the parts of the respective link. At its other end each link 18 is connected to an axle 21, which is rotatably mounted each in a swinging arm 22 through a bearing 23 located with the parts of the respective link. The axles 21 of the two swinging arms are interconnected through a parallel guide rod 24 consisting of two parallel parts and like the axles 19 are provided at each end with washers 25 and locking rings 26, which fix the axles against movement in axial direction.

Each swinging arm 23 is rotatably suspended on an eccentric axle 27, which by axle journals 28 are rotatably mounted in bearings 29, with bearing holders 30 secured by screws in the upper sidewalls 31 of the stand. One of said swinging arms 22 is formed at one end with a stop shoulder 32, which in co-operation with a stud 33 provided in the associated link 18 between the parts thereof limits the clockwise movement of the swinging arm to the position shown in FIG. 1 which position the parts as shown in FIG. 2, and at its other end is formed with a fastening lug 34 for a piston-cylinder device 35, which operates between said fastening lug and the stand 2 for swinging the swinging arms 22. Upon projection of the piston rod 36 of the piston-cylinder device in the position shown in FIG. 2, the swinging arm 22 connected to the piston rod is swung counter-clockwise about the centre point 37 of the eccentric axle, and to a corresponding degree also the other swinging arm is swung about its axis, due to the parallel guide bar 24, whereby also the tool holder plate 11 with the punch 3*a* is lifted from the position of preparedness for bending to an upper starting position for obtaining a relatively large gap between the upper and the lower tool parts. For lowering the tool holder plate 11 with its punch 3*a* to the position of preparedness, thus, the piston rod 3*a* of the piston-cylinder device is caused to move in opposite direction and thereby swings the swinging arms 22 clockwise until the stop shoulder 32 meshes with the stud 33, whereby said position of preparedness has been obtained. Due to the piston-cylinder device 35 acting directly on one swinging arm 22, the lowering and lifting of the plate 11, and therewith of the punch 3*a*, takes place rapidly between the starting position and the position of preparedness.

For lowering the tool holder plate 11 with its punch 3*a* from the position of preparedness to a bending position, and for effecting necessary bending or pressing forces for bending corrugated metal sheet inserted between the punch 3*a* and the die 3*b*, a piston-cylinder device 38 is provided. This device is hingedly attached at one end to the stand 2, and its piston rod 39 is rotatably mounted by means of a journal 40 and a bearing 41 in a rotary lug 42, which is rigidly connected with one eccentric axle 27. On this axle also an additional rotary lug 43 is fastened, which is connected to a corresponding rotary lug 44 mounted on the other eccentric axle 27 through a link rod 45, which preferably is adjustable as to its length and at its ends is rotatably mounted in the respective rotary lug by means of journals 46 and bearings 47. By this link rod 45, thus, the eccentric axles are rotated simultaneously and to the same extent about the respective rotary axles 48.

Upon projecting the piston rod 39 of the piston-cylinder device in the position of preparedness shown in FIG. 1, the two eccentric axles, thus, are rotated simultaneously about the respective rotary axle 48 and thereby through their eccentrics 27 cause the swinging arms 22 together with the links 18 and the tool holder 5 to be moved downward to the bending position with the force required for bending a sheet to a predetermined angle by co-operation of the punch with the stationary die 3*b*. The movable dies 3*c* are in a retracted position, as shown in FIG. 6.

During the bending phase, i.e. during the movement of the punch 3*a* to and from the bending position, the piston-cylinder device 35 is in floating position, so that its piston rod 36 can move freely.

Each of the lower tool holder plates 9 carrying the dies 3*c*, which plates are arranged identically each in a lower part 50 of the stand, extends outward through openings 51 in the end walls 12 of the stand and is provided at its ends with slide strips 52, by means of which they are movably guided between parallel guide strips 54 attached by screws 53 to the end walls 12. Said guide strips are adjustable by means of set screws 55 located on bars 56 attached to the end walls. In order to prevent the tool holder plate 9 from moving in its longitudinal direction between the end walls 12, it is provided with at least one guide roller 57 at each end, which rollers co-operate with a guide bar 58 attached to the inside of the end wall, possibly by means of the same screws 53, which are used for attaching the guide strip 54 located on the outside of the end wall.

Each tool holder 9 formed as a plate carries two spaced links 60, each of which is hingedly connected to the plate 9 by means of a stud 61 and a bearing 62, and at its other end is rotatably mounted each on an eccentric axle 63, which by means of their axle journals 64 are mounted in bearings 65 in bearing holders 66 secured by screws in the sidewalls 67 of the stand. The two eccentric axles 63 are provided each with a rotary lug 68, and these lugs 68, which are rigidly connected to the axles 63, are interconnected by a link rod 69 for effecting simultaneous rotation of the two axles 63. One of said axles further is provided with an additional rotary lug 70, in which a piston rod of a piston-cylinder device 72 hingedly attached to the stand 2 is hingedly attached by means of a stud 70*a*. For rotating the eccentric axles 63 about their centre of rotation 73 and thereby for lifting and lowering the tool holder 9 in response to the movement of the other tool holder 9 to and from the bending position, the piston-cylinder devices 72 of the two tool holders 9 are synchronized with one another, so that the movement of the tool holders, and therewith of the dies 3*c*, to and from bending position takes place simultaneously.

At the embodiment shown in FIGS. 1–3, each piston-cylinder device is connected at its end remote from the piston rod 71 to a cylinder mounting 74, which is located on an axle 75. Said axle 75 is located eccentrically within a greater axle 76, which is mounted in brackets 77 attached to the stand. On the axle 76, between the brackets 77, a rotary lug 78 connected non-rotary to the axle 76 is provided which rotatably carries a stud 79 with a threaded hole, into which a threaded adjusting rod 80 is screwn. Said rod extends through the stand wall 67 and outside of this is provided with a wheel 81 and is rotatably mounted in the wall 67 through a bearing bushing 82.

By rotating the rod 80, thus, the rotary lug 78 rotates the axle 76, and thereby the axle 75 eccentrically located therein, and therewith said cylinder mounting 74, are moved in one direction or the other, depending on whether the rod is rotated clockwise or counter-clockwise. It is thereby possible to adjust the rotary lugs 68 connected to the eccentric axles 63 to the desired angular position for obtaining the intended bending position for the dies 3*c*, i.e. their upper end position. This end position, however, is adjustable in vertical direction and by changing this upper end position it is also possible to change the angle to which the sheet is to be bent. The greater the desired bending angle, the higher the upper end position is located.

The end positions of the movable dies also can be determined, for example, by stationary guide members 84,85. For actuating said members, arms 86,87 are provided which are connected to the axle journal 64 of one eccentric axle and adjustable relative to each other. In the upper end position shown, the arm 86 has contacted the guide member 84, which thereby causes the piston-cylinder devices 72 to change the direction of movement in order to lower the dies 3c, and when the lower end position has been assumed the arm 87 actuates the guide member 85, which thereby causes the piston-cylinder devices 72 to remain in this position and to wait for a starting impulse. By changing the angle between the two arms 86 and 87, the desired end positions for the dies 3c can be set simply and rapidly.

The tool 3, as already mentioned and as shown in detail by FIGS. 6 and 7, comprises an upper punch 3a, which has three downward projecting fingers 90 and 91, which in strip shape extend over the entire length of the punch and therewith over the entire width of the sheet to be bent. The central finger 90 thereof is located in the plane of vertical movement of the punch, while the remaining two fingers 91 are located angularly relative to the central one, which angle can vary from one case to another, but preferably should correspond to the angle between the plane of movement 10 of the dies and that of the punch. The tool further comprises the dies 3b and 3c, each of which has at least the same length as the punch 3a, and which show support members or teeth 92 and recesses therebetween, which alternate in a way corresponding to the ridges and valleys or corrugations of the shaped sheet to be bent. For a trapezoid shaped sheet the support members 92 may have the lateral form shown in FIG. 6a, i.e. a form adapted to the cross-sectional form of the ridges and valleys. The cross-sectional form of the support members of the dies is as shown in FIGS. 6 and 7.

According to the principles, on which the method according to the present invention is based, the bending is carried out in two subsequent steps. At first the punch 3a is moved from its position of preparedness to the bending position, which is shown in FIG. 6, and in which the punch with its central finger 90 projecting through a longer distance than the two outer fingers 91 has effected an impression in those portions of the sheet A inserted between the punch 3a and the dies 3b and 3c which are facing to the punch 3a. Said impression is located between the projections 93 of the support members 92, which projections are upwardly rounded-off. With its outer fingers 91 the punch has effected slightly less deep impressions on both sides of the impression made by the finger 90. The sheet A thereby has been bent partially by the formation of a transverse ridge in each volley V of the corrugated sheet A, the number of mutually aligned punch and die sets required depending on the number of corrugations in the sheet A. In the second bending step the movable lateral dies 3c are caused to project upward on the outside of the outer fingers 91 of the punch, but first after the punch 3a has completed its movement stroke and clamps the sheet against the die 3b. Said dies 3c thereby bend the sheet A about the fingers 91 of the punch and, thus, complete the bending of the sheet to the desired angle, as shown in FIG. 7, where the bending angle is 90°. However, by changing the upper end position of the dies 3c, as described above, also other bending angles can be obtained.

At the return movement of the punch to its position of preparedness, the bent sheet can follow along with the punch 3a. In order to remove the sheet from the punch, the apparatus can be equipped with a stripper 95 on each side of the punch, as shown in FIGS. 8 and 9. Each such stripper is shown to comprise a carrying beam 96, which extends between the end walls 12 of the stand, and which at its ends is attached to swinging arms 97, which are connected pivotally each with an arm 98, which are attached to a bracket 99 secured by screws in the respective end wall 12. On the carrying beam 96 a number of bogie wheels 100 acting as dollies are suspended by means of mountings 101, in which the bogie wheels are freely pivotal. At the mountings 101 of the outer bogie wheels rotary sheet holders 102 are provided, which are rotated by a motor 103. The carrying beam 96 is supported on a piston-cylinder device 104, which is hingedly attached to the upper sidewall 31 of the stand, and by means of which the carrying beam 96 can be pivoted about the swinging centre 105 of the swinging arms 97.

At the bending operation, the sheet is pivoted upward by the movable dies 3c and thereby contacts the bogie wheels 100, which thereby adjust after the sheet A. Thereafter the motors 103 pivot the sheet holders 102 below the edges of the sheet and clamp the sheet A against the bogie wheels 100. The sheet thereby is locked in the stripper 95, When then the upper punch 3a returns to its position of preparedness, the sheet is released automatically from the punch 3a. By means of the piston-cylinder device 104 the sheet then can be pivoted downward and placed on a conveyor (not shown in FIGS. 8 and 9) for being advanced through the bending frame, whereafter the stripper automatically returns to its starting position shown in FIG. 8 for handling the next sheet.

In FIG. 10 a plant for manufacturing pallets is shown schematically. In this plant blanks of corrugated sheet metal and preferably trapezoid corrugated sheet metal cut to a suitable length are bent. The plant comprises, in addition to a bending frame 110 according to the invention, a supply table 111 with a supply of cut to size sheet metal blanks 112, an infeed table 113 and a discharge table 114.

From the supply one sheet blank at a time is taken by a magnetic lifting device 116, which is movable along guide means 115 and transfers the sheet blank to the infeed table 113, whereafter the lifting device returns for fetching the next sheet blank. On the infeed table the sheet blank is carried on roller conveyors 117 and guided by a guide bar 119 provided with rollers 118 while it is advanced by means of dog members 120, which by a cross-rod 121 are connected to two cylinders 122, preferably so-called Origa-cylinders, acting as drive means. At the end of the infeed table facing to the bending frame 110, a number of carrying bars 123 are provided, which are hingedly attached to the infeed table and are carried by the stationary die 3b in recesses between the supporting members 92 thereof for guiding the sheet into correct position in the bending frame.

The discharge table 114 shown in greater detail in FIGS. 13 and 14 comprises two conveyor belts 128, which are driven by a worm gear motor 125 via a shaft 126 and elastic coupling 127. Each conveyor belt 128 is provided with a belt stretcher 129, a guide bar 131 provided with rollers 130 for guiding the sheet, and a movable sheet stop member 132 adjustable in different positions and moved to the different positions by means of the cylinder 133, preferably pneumatic and of Origatype. Said cylinder 133 is supported on a cylinder stand 134 with mounting plates 135, and the stand in its turn is supported on links 137 hingedly attached to the table frame by axles 136. Said links also are hingedly attached to the mounting plates 135 of the cylinder stand by means of axles 139 mounted in bearing bushings 138. Between the table frame and the cylinder stand 134 a piston-cylinder device 140, preferably pneumatic or hydraulic, is provided for lifting and lowering the cylinder stand 134 and therewith a stop member 141, which is located at the stand end facing to the bending frame 110. A number of clamping tools 142 and a number of limit switches (not shown) for the different positions of the movable stop member 132 are also provided.

When a sheet blank 112 is being fed into the bending frame 110, the blank is stopped against the stop member 141 on the discharge table. Thereby the bending frame is started and carries out a bending operation in the way described above for bending the sheet blank through 90°. The sheet blank 112 thereby has been bent a first time and assumed the shape shown in FIG. 15*a*. After the stripper 95 has put down the sheet blank on the feed conveyor, and after the stop member 141 has been lowered and the movable stop member 132 has assumed a predetermined forward stop position, the sheet blank is advanced a further step by the dog members 120 of the infeed table to abut the stop member 132. Thereby the bending frame is started again and carries out its bending operation for effecting a second bending of the sheet blank through 90°, as shown at 145 in FIG. 15*b*. Thereafter the movable stop member 132 moves to a rear end position, and the sheet blank 112 is advanced against said stop member, whereafter the sheet blank is bent through 90° at its other end as shown at 146 in FIG. 15*c*. Thereafter the sheet blank is moved in the opposite direction by the stop member 132 to a new position, in which the sheet blank is bent through 90° inside of the bending 146 effected last, as shown at 147 in FIG. 15*d*. Thereby the sheet blank has been bent four times and formed to a pallet.

For rendering it possible to remove the pallet from the bending frame 110, the punch 3*a* must be lifted to the said starting position. This lifting is effected by the piston-cylinder device 35.

In FIGS. 16*a–e* a similar bending sequence as the one shown in FIGS. 15*a–d* is illustrated, but in this case for producing a pallet of a type other than that shown in FIGS. 15*a–d*, viz. a pallet with inward folded edge portions 150 acting as supporting legs.

Figure 16A:
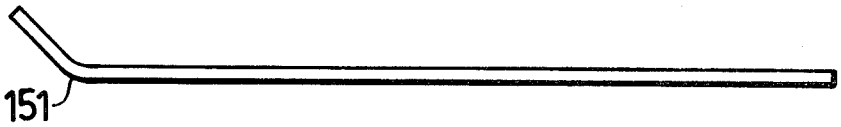
Figure 16B:
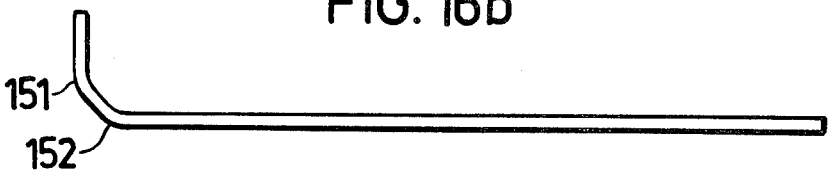
Figure 16C:
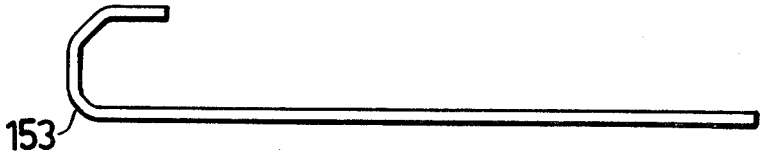
Figure 16D:
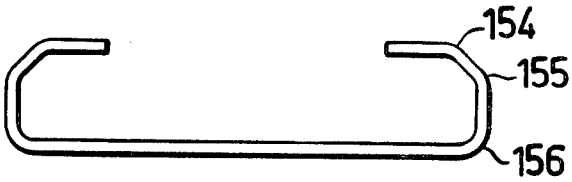
Figure 16E:
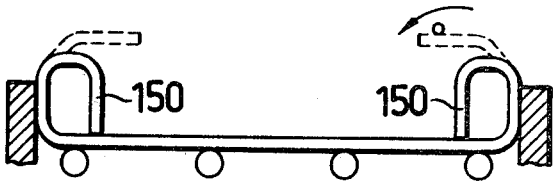

In this case the sheet blank is bent at first through 45°, as shown in FIG. 16*a* at 151, then advanced through one step and bent through 45°, as shown in FIG. 16*b* at 152, then advanced through a further step and bent through 90°, as shown in FIG. 16*c* at 153, and then advanced through a long step to be bent at its other edge through 45°, as shown in FIG. 16*d* at 154. Thereafter the sheet blank is fed in the opposite direction through one step and bent through 45°, as shown at 155 in FIG. 16*d*, and finally it is advanced through a further step in the same direction to be bent through 90°, as shown at 156 in FIG. 16*d*. Thereafter the sheet blank is discharged from the bending frame, and the edge portions 150 previously mentioned now can be folded inward by means of a pressure bar 161 pivotal about an axle to the position shown in FIG. 16*e*. At the inward folding of the edge portions 150, the pallet abuts a support 162 as shown schematically in FIG. 16*e*.

The present invention is not restricted to the embodiment described above and shown in the drawing, but can be altered and modified in many different ways within the scope of the invention idea defined in the attached claims.

I claim:

1. An apparatus for bending a sheet metal shape having at least one corrugation formed by interspaced ridges and a valley between the ridges, about an axis perpendicular to the corrugation, by forming a plurality of adjoining sheet-bending corrugations inwardly in the valley, the apparatus comprising a primary die and a punch positioned cooperatively opposite to each other and adapted to be moved together when the shape is positioned transversely between them with the inside of the valley in contact with the primary die, the primary die having two interspaced fingers which transversely engage said inside and the punch having three fingers which contact the valley's outside and mesh with the primary die's fingers when the primary die and punch are closed together, actuating means for moving the primary die and punch together so as to form one and on both sides thereof partially form two more of the sheet-bending corrugations in the valley and partially bend to shape about said axis, means for holding the primary die and punch together so as to clamp the shape's valley therebetween, and secondary dies on both sides of said primary die and which are movable towards the valley's inside so as to overlap the punch's two outer fingers, and means for moving said secondary dies towards the punch so as to bend the shape's valley about the punch's two outer fingers and completely form three bending corrugations in the shape's valley.

2. The apparatus of claim 1 in which the two interspaced fingers of the primary die and the middle finger of the punch extend perpendicular to the shape's valley and said actuating means move the primary die and punch linearly together and perpendicularly to the sheet's valley, and the punch's two outer fingers are angled radially towards said axis, said secondary dies being movable angularly substantially parallel to the punch's outer fingers.

* * * * *